US005944314A

United States Patent [19]

Stavinsky

[11] Patent Number: 5,944,314

[45] Date of Patent: Aug. 31, 1999

[54] METHOD FOR PLAYING A CARD GAME

[76] Inventor: Emil G. Stavinsky, 6676 Boxwood La., Las Vegas, Nev. 89103

[21] Appl. No.: 09/032,221

[22] Filed: Feb. 28, 1998

[51] Int. Cl.[6] ..... A63F 1/00

[52] U.S. Cl. ..... 273/292

[58] Field of Search ..... 273/292, 274; 463/13, 12

[56] References Cited

U.S. PATENT DOCUMENTS 5,141,234 8/1992 Boylan et al. ..... 273/306

5,632,487 5/1997 Nguyen ..... 273/292

OTHER PUBLICATIONS

"Thirty–One", Scarne's Encyclopedia of Games, John Scarne, Harper & Row publishers, p. 324, 1973.

*Primary Examiner*—Benjamin H. Layno

*Attorney, Agent, or Firm*—Quirk & Tratos

[57] ABSTRACT

Methods for playing a card game are set forth wherein the dealer and player are dealt cards and the next card from the deck is turned over to define a trump suit. In one method, the values of trump cards are compared to determine winning outcomes and a side wager can be provided which relates to certain pay table trump card combinations. If the player has one of the predetermined trump card combinations, a payoff is provided. In another embodiment, the player and dealer form a trump card hand and a non-trump card hand and the hands are compared to determine winning outcomes. In still a further embodiment the player, prior to the deal, wagers on a selected suit and the cards of the trump and selected suits are compared to determine winning outcomes.

19 Claims, 1 Drawing Sheet

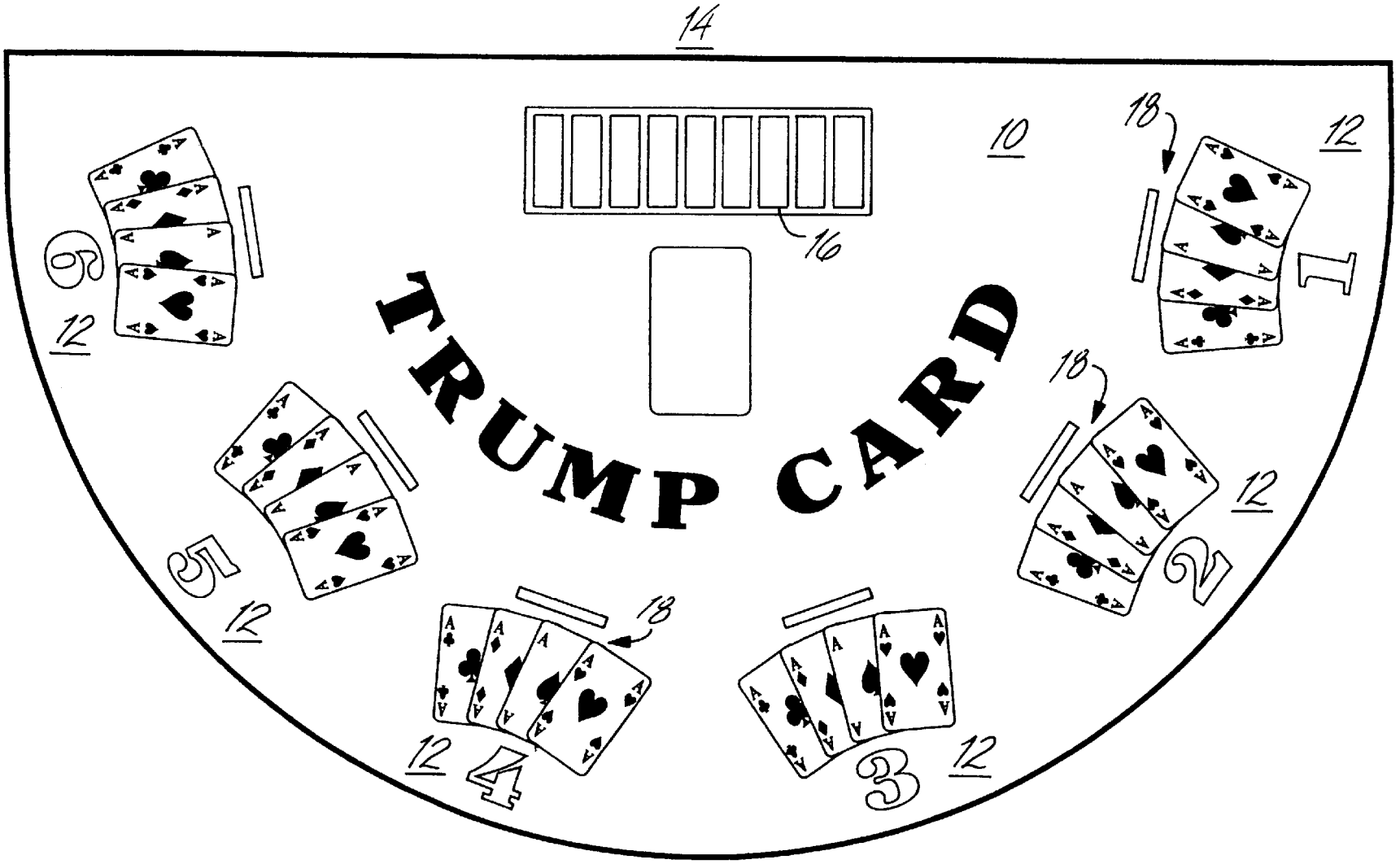
TRUMP CARD
1
2
3
4
5
6
10
12
13
14
16

METHOD FOR PLAYING A CARD GAME

FIELD OF THE INVENTION

The present invention relates to games played with playing cards and more particularly to card games of the type where players make wagers of money, credits or points and play against the dealer or house to determine whether the player wins or loses the wager.

BACKGROUND OF THE INVENTION

Various card games have been devised by which a player can make a wager of money, where the setting is a casino, or credits or points when the player is playing for fun and enjoyment. After the wager has been made, the player and dealer are dealt playing cards to ultimately define final holdings for each of the player and dealer. The dealer's and players' hands are then compared and resolved to determine the winner. If the player is declared the winner based upon the final holdings, the player wins the wager and collects a reward. If the dealer is declared the winner, the player loses the wager. Examples of such games are Blackjack, Pai Gow Poker and the like.

While these games have enjoyed success, players continue to look to the challenge and excitement of new games. Furthermore, players look to play games where they have an opportunity to reap great rewards in comparison to the amount of their wager. For example, in Blackjack, the greatest reward a player may expect to receive is 3:2 for a Blackjack.

There is, therefore, a need for new card games which are easy to understand and play and which offer the opportunity for players to receive large awards for relatively small wagers.

SUMMARY OF THE INVENTION

There is, therefore, set forth according to the present invention several embodiments of a method for playing a card game between a dealer and a player using playing cards. In one embodiment, after the player has made a wager, an initial holding of an equal number of cards are dealt to the player and dealer, with the next card from the deck turned face up, the suit of the turned up card defining the trump card. The player at this point opts to continue or fold. If the player opts to continue, the player makes a second wager matching his initial wager to receive an additional card. If the player opts to fold, the player loses their initial wager and it is collected. For the player opting to continue and who has placed a second wager, both the player and dealer receive a first additional card whereupon the player may again opt to continue or fold. If the player opts to fold, he loses his first and second wagers and they are collected. If he opts to continue, he makes a third wager matching the first wager and he and the dealer are dealt second additional cards to complete their hands. The completed dealer's hand and player's hand are then resolved by comparing the sums of values of the trump suit cards of the player's hand to that of the dealer's. If the player's sum is greater, the player's hand is declared a winner and the player is rewarded based upon each of the first, second and third wagers. If the dealer's sum is greater, the player's hand is declared a loser and all of the player's wagers are collected. If the cumulative sum of values is the same, the hand with the highest ranking trump suit card is declared the winner. If neither the player or dealer have any trump cards, the hand with the highest ranking non-trump suit card is declared the winner.

According to this embodiment, the player may also make an optional side wager to receive a greater payoff depending upon the additive sum of the trump cards, number of trump suit cards and the nature of the holding of trump suit cards.

In a further embodiment, the method includes dealing seven cards to the player and dealer and turning the next card from the deck face up, the suit of the turned up card defining the trump suit. The player and dealer organize their seven cards into a trump hand containing only trump suit cards and a second suit hand all cards of another suit. The trump hand and second suit hands of the player and dealer are resolved against one another. If the player's sums of the values of the cards of the trump suit hand and second suit hand are greater than the dealer's, the player's hands are declared winners and the player is paid even money based upon his wager. If the dealer's sums of each of the corresponding hands are greater than the player's, the player's hands are declared losers and the player's wager is lost. If only one of the player's hands has a greater sum than the dealer's, the hands are declared a push and the player does not lose or win their wager.

In a third aspect of the present invention, the method includes the player making a wager and selecting a card suit. Five cards are dealt to the dealer and player with the next card from the deck turned up, the suit of the turned up card defining the trump suit for the hand. Thereafter the player's hand and dealer's hand are resolved. The dealer or player with the most trump and selected suit cards is declared the winner. If the player is declared the winner, the player is paid even money on their wager.

In still a further aspect of the present invention, the player makes a wager and dealer and player are each dealt two cards, with one of the dealer's cards exposed. The player examines their two cards and opts to either stand or double their wager and receive an additional two cards. The player's two card or, if opted, four card holding defines the player's hand. If any player at the table has make the double wager and received the additional two cards, the dealer deals himself/herself two additional cards as well. The player assesses their hand. From the final hand the player looks to determine if they have at least two cards of any suit. If so that suit is determined to be the trump suit and the values of the trump suited cards are summed, modulo ten. For example, if the player's final hand consists of four cards, Ace of Hearts, 10 of Hearts, 3 of clubs and 6 of diamonds, the only cards which can be used by the player to obtain a final hand total are the two Heart suited, trump cards and those cards have a sum, and the final hand has a total, modulo ten, of one. The final totals of the hands of each of the players and the dealer are compared. The dealer's hand may have a total attributable to a different trump suit than used by the player. Again only cards belonging to a suit of two or more cards are compared. If there are two suits of two cards each, only the suit with the highest sum, modulo ten, is considered the trump suit for determining the hand total, e.g. a hand of a 2 of Spades, 7 of Spades, 10 of Diamonds 5 of Diamonds would have a sum value and final hand total of 9 attributable to the Spade trump suit (the diamond suit has a sum of 5). If a three or four card suit exists, the values of all cards are summed, modulo ten. As between the dealer and player, the one with the highest final hand total is declared the winner and the wager is either collected, if the player loses, or is paid even money, if the player is declared the winner. If the player does not have at least two cards of a suit (and no trump suit can be assembled) and the dealer does, the player is declared the loser. If neither the dealer or player have two cards of any suit, the hand is declared a push. If the player has two suits of two cards each and the sums are equal, i.e. two trump suits, the player is declared the winner and is paid 2:1 regardless of the dealer's final hand total, unless the dealer likewise as two suits of two cards each of which have equal sums greater than the player's equal sums. In that instance the dealer is declared the winner. Further if both the dealer and player have final hand totals of 0, the dealer is declared the winner.

As can be appreciated, the various methods for playing the game according to the present invention utilizing a trump suit provide for fast action and the hands are quickly and easily resolved. There are no complicated rules regarding drawing nor is any complicated strategy required. Furthermore, for certain embodiments, depending upon the holding of the player, they can be paid at odds greater than even money.

BRIEF DESCRIPTION OF THE DRAWING

These and other features of the present invention will become better understood with reference to the description, claims and drawing which shows a layout for playing the game.

DESCRIPTION

Turning to the drawing, a layout 10 is shown which includes positions 12 for players to play the game according to the present invention. Opposite the player positions 12 is a dealer position 14 to be occupied by the dealer. At the dealer position is a chip tray 16 to hold the chips received and paid out during play of the game. Each player position 12 includes indicia 18 representing each suit of a deck of cards to facilitate the player making wagers on one or more suits during play of the game. With the layout 10 described, the various embodiments of the game according to the present invention will now be described.

According to one embodiment of the method of the present invention, a player plays against a dealer. While several players can play against the dealer in a fashion like the table game of Blackjack, the game can also be played in an electronic format with a processor selecting from a data structure including data representing each card of a deck of 52 cards, the various player's hands and controlling the action as hereinafter described. For simplicity, it will be presumed that the game as hereinafter described is played in a table game format at the layout 10 with one player against the dealer. However, it is to be understood that the table game format can be played by many players against the dealer and that the method and the various other embodiments of the method of the present invention can be incorporated into an electronic format wherein the play is controlled by a suitable processor.

To play the game, the player makes a first wager of a selected amount. Table minimums and maximums may control the amount of the wager. After the player has made their wager, from a deck of playing cards an initial holding of an equal number of cards are dealt to each of the layer and dealer. The initial hands may be of three cards, four cards or five cards each. After the initial holding is dealt to the player and dealer, the next card from the deck is turned face up. The suit of the turned up card defines the trump suit for this hand of play.

The method continues with the player viewing their initial holding and opting to continue with the play of the hand or to fold. If the player opts to fold, the player so indicates by handing their cards toward the dealer. If the player folds, their first wager is lost and the play is over. If the player opts to continue, the player makes a second wager in an amount equal to and matching the initial wager as a condition to receive an additional card. When the second wager is made, the dealer deals a first additional card to the player and to the dealer. Upon viewing the first additional card, the player again has the option to continue or fold. If the player opts to fold, he passes his cards toward the dealer and his first and second wagers are lost and collected by the dealer. If, on the other hand, the player opts to continue, the player places a third wager matching the first wager to receive a second additional card. If the player makes the second additional wager, the dealer deals a second additional card to himself and the player. At this point, the hand of the dealer and player are completed. No further cards will be drawn or dealt. The player and dealer expose their hands and compare the sums of the values of the trump suit cards in each of their respective players and dealer's hand. In valuing the trump cards, the cards may be valued in the traditional fashion with the cards 2 through 10 being valued by their face value or number of pips and the Jack, Queen, King and Ace being valued at 11, 12, 13 and 14, respectively. Preferably, however, to make the summing of the value of the trump cards easier, the 10s through Kings are each valued as 10 or 0 with the Ace valued as 1 or 11, with the remainder of the cards valued at their face value.

If the sum of the trump cards and the player's hand is greater than the sum of the trump cards in the dealer's hand, the player's hand is declared a winner and the player is paid even money for each of their first, second and third wagers. If the dealer's sum of trump cards is greater than that in the player's hand, the player's hand is declared a loser and all of the player's wagers are lost and are collected by the dealer. If the sum of the trump cards in the dealer's and player's hands are the same, the hand with the highest ranking trump card according to the rules of Poker as between the dealer and player will be declared the winner. If neither the player or the dealer have any trump cards, the hand with the highest ranking non-trump card according to the rules of Poker as between the player and the dealer is declared the winner.

As a further feature of this embodiment of the method of the present invention, the player may opt prior to the dealing of cards to make a bonus wager. To win on the bonus wager, the player must continue with the play of the game opting to take the first and second additional cards as set forth in the basic method for playing the game. Payoffs for the bonus wager are based upon the sum of trump cards in the player's completed hand and can also be based upon the nature of the trump card holding in the player's hand. Table 1 below sets forth the preferable player trump card holdings and payoffs.

TABLE 1

| No. of Trump Cards | Sum of Trump Cards | Payoff |
|---|---|---|
| 2 | 17–21 | 1 to 1 |
| 3 | 22–26 | 2 to 1 |
| 3 | 27–31 | 3 to 1 |
| 4 | 17–21 | 4 to 1 |
| 4 | 22–26 | 5 to 1 |
| 4 | 27–31 | 7 to 1 |
| 4 | 32–36 | 10 to 1 |
| 4 | 37–40 | 15 to 1 |
| 5 | Any | 20 to 1 |
| 5 | Poker Straight | 50 to 1 |

By a Poker straight, what is meant is that the trump cards form a straight according to the rules of Poker.

As still a further embodiment of the method of the present invention, a portion of each bonus wager may be allocated to a progressive jackpot. Should the player have five trump cards which comprise a Royal Flush according to the rules of Poker, the player would be awarded the progressive jackpot.

As yet a further feature, a player may opt to make a side wager that the trump suit will be red (hearts or diamonds) or black (clubs or spades). This wager can be indicated by the player placing the wager on the corresponding color indicia 18 in the layout 10. The player wins even money if they have wagered upon the correct trump suit color.

Where the cards are valued with the 10s through Kings valued as zero and the Aces as 1, the schedule of payouts for any bonus wager reflected in Table 1 would have to be adjusted to reflect the zero values of 10s through Kings and the 1 value for Aces.

A further embodiment of the present invention consists of the player making a first wager. The dealer deals an initial holding of seven cards to the player and the dealer and turns up the next card from the deck face up, the suit of the turned up card defining the trump suit, e.g. hearts, for the hand. The player and dealer organize their seven cards into a trump suit hand, containing only trump suit cards (hearts), and a second suit hand all of cards of another suit, e.g. spades. Cards of other suits, diamonds and clubs, are not considered and are removed from play. After the player and dealer have organized their two hands, the hands are resolved by comparing the dealer and player's trump suit hand and the dealer and player's other suit hand. For the above example, if the trump is hearts, the player and dealer would, if they have any hearts in their hand, organize them into a trump suit hand. Each of the player and dealer would then select their highest sum which can be formed of cards of another suit and arrange those cards into the non-trump suit hand.

If the player's sums for each of the hands are greater than the corresponding sums of the dealer's hands, the player is paid even money based upon their wager. Conversely, if the dealer's sums of the trump suit hand and the non-trump suit hand are greater than the corresponding sums of the player's trump suit hand and non-trump suit hand, the player's hand is declared a loser and the player loses their wager which is collected by the dealer. If the player's sum of one of their hands is greater than that of the corresponding dealers but the sum of the second hand is not, the hands are declared a push. In summing the hands, the face value of the cards can be used or in the alternative, the 10s through Kings can be valued as 10s with the Aces as 11 or the 10s through Kings can be valued as zero with Aces as 1.

In a further embodiment of this invention, the player is required to make first and second wagers, the first and second wagers allocated respectively to each of the trump and second suit hands. Both hands are separately considered and the player can win one or both or lose both hands and their corresponding wagers.

A third embodiment of the method of the present invention includes the player selecting a card suit and making a wager with respect to that suit. The suit selected is indicated by the player placing their wager in the corresponding suit of the indicia 18. Five cards are dealt to the dealer and player with the next card in the deck turned up, the face up card defining the trump suit for the hand. Thereafter, the player and dealer hands are resolved. The resolution is by comparing the number of cards of the selected suit and trump suit in the dealer's hand to the number of cards of the selected suit and trump suit in the player's hand. The dealer and player with the most trump and selected suit cards is declared the winner. If the player is declared the winner, the player is paid even money and if the dealer is declared the winner, the player's hand is declared a loss and the player's wager is collected. As a further embodiment of this invention, if the player is declared the winner and the selected suit and trump suit are the same, paying the player 1½ times their wager.

In a fourth embodiment of the present invention, each player makes an initial wager the amount of which may be dictated by table minimums and maximums. After all wagers have been made, one card is dealt to each player and the dealer face up, this card defining the first card of the dealer's hand and each player's hand. The next card from the deck is turned over and does not become part of any hand but instead the suit of this next card defines the trump suit for the play of this hand.

The player then evaluates their hand as defined by the first card. If the first card is greater than six, with cards 2–9 counting their face value and cards Ace, King, Queen, Jack and ten counting a value of one, the player's hand is a loss and their wager is collected subject to the dealer also having their first card with a value over six whereupon the push rules described below apply. If the Player's first card is less than 6 the player has the option to receive additional cards attempting to build a completed hand the sum of values of which is six or as close to six as the player thinks they can come without exceeding six. If the player takes another card and the sum value of all cards in his hand exceeds six, the player's hand is declared a loss and their wager is collected. It is to be noted that in summing the values of cards in the player's and dealer's hand, the values described above, i.e. Ace-10 count as one, apply and the suit of the cards is irrelevant. For example, a 3 and a King would have a sum of values of 4.

If the player takes a second card and it is a pair to the first card, e.g. a pair of Kings, the player may split their hand into two hands by making an additional wager matching their original wager. The two hands are then completed by the player standing (not taking additional cards) or taking additional cards attempting to get as close as possible to six without going over six ("busting").

After the player has completed their play the dealer then stands on their first card if it has a value of 3–6, takes an additional card(s) until the sum value is at least three or has busted by the first card having a value greater than six. If the dealer takes additional card(s) and the sum of the value of cards exceeds six, the dealer busts and the player is declared to be the winner and is paid even money.

After the dealer and player have completed their hands the hands are compared and resolved. If the player's hand has a sum of values six or less but greater than that of the dealer, the player's hand is declared the winner and the player is paid even money on their wager. If the dealer's sum of values of their completed hand six or less but greater than the sum of the values of the cards of the player's hand the dealer hand is declared the winner and the player's wager is lost and is collected. If the dealer and player hands have the same sum of card values the hands are declared a push. When a push is declared, the tieing hands are examined to determine the value of any trump cards in the hands. The pushing hand with the greater sum of values of trump cards is declared the winner and the player's wager is either lost or paid at even money. For example, if the trump suit is hearts and the player's hand includes a 3 of spades and a King of hearts and the dealer hand consists of a 3 of diamonds and a Jack of spades, the player's hand is declared the winner because of the presence of the King in the trump suit. If neither hand has trump or the trump suit cards have the same sum of values, the hands are a push and the player's wager is neither won nor lost.

After the hands have been resolved the player cards are removed from play, new wagers are made and new hands dealt.

In still a further aspect of the present invention, each player makes a wager and dealer and player are each dealt two cards, with one of the dealer's cards exposed. The player examines their two cards and opts to either stand or double their wager and receive an additional two cards. The player's two card or, if opted, four card holding defines the player's hand. After the player has exercised their option to double, the dealer deals himself/herself two additional cards as well. The player assesses their hand. From the final hand the player determines the suit with the most cards, of at least two cards, which becomes the trump suit and the values of the trump suited cards are summed, modulo ten. For example, if the player's final hand consists of four cards, Ace of Hearts, 10 of Hearts, 3 of Clubs and 6 of Diamonds, the only cards which can be used by the player to obtain a final hand total are the two, Heart suited, trump cards and those cards have a sum, and the final hand has a total, modulo ten, of one. The dealer makes the same determination to arrive at a final hand sum of trump cards. The final totals of the hands of each of the players and the dealer are compared. The dealer's hand may have a total attributable to a different trump suit than used by the player. For example, Table 2 below shows various hands dealt to the player and dealer.

TABLE 2

| Dealer Hands | Player Hands |
|---|---|
| 1. 3♡,7◇,6♡,10♤ | 5♧,K♧,J♧,7♤ |
| 2. 7◇,K◇,A♤,5♤ | K♧,Q♧,J♡,10♡ |
| 3. 3◇,2},4♤,A♤ | A♡,3♡,3♧,A♧ |

Again only cards belonging to a suit of two or more cards are compared and the suit with the most cards determines the trump suit. If there are two suits with an equal number of cards, but at least two cards, only the suit with the highest sum, modulo ten, is considered the trump suit for determining the hand total. If a three or four card suit exists, the values of all cards are summed, modulo ten.

With reference to Table 2, the dealer and player final hand total sum values for the three example hands are therefore, according to the this embodiment of the method: Hand 1—dealer 9 (Hearts), player 5 (clubs), Hand 2—dealer 7 (Diamonds), player 0 (either suit), Hand 3—-dealer 5 (either suit), player 4 (either suit).

As between the dealer and player, the one with the highest final hand total is declared the winner and the wager is either collected, if the player loses, or is paid even money, if the player is declared the winner. If the player does not have at least two cards of a suit (and no trump suit can be assembled) and the dealer does, the player does not qualify and is declared the loser. If neither the dealer or player have two cards of any suit, the hand is declared a push. If the player has two suits of an equal number of cards such as two cards each and the sums are equal, i.e. two trump suits of equal sums, the player is declared the winner and is paid 2:1 regardless of the dealer's final hand total such as shown in Table 2, Hand 2. However if the dealer likewise as two suits of two cards each of which have equal sums greater than the player's equal sums such as shown in Table 2, Hand 3, the player is declared the loser. Further if both the dealer and player have final hand totals of 0, the dealer is declared the winner.

To reduce the occurrence of pushes where the player and dealer have the same hand totals, the number of cards in the respective trump suits of the player and dealer, e.g. in Hand 1 of Table 2 the player has three Clubs in his trump suit and the dealer has two Hearts in his trump suit, may be compared with the one having the greatest number of trump suit cards declared the winner. If both have the same number, the hands remains a push.

In a further aspect of this embodiment, the player may opt, in addition to their base wager and prior to the dealing of the cards, to make a red or black wager. If the player's declared trump suit matches in color the wagered upon color, the player is paid even money on their color wager.

In still a further aspect of the present embodiment of the present invention, the play may consist of the dealer and player each being dealt two cards with three community cards dealt at the center of the table to be used by both the dealer and player. In this embodiment, the suit with the greatest number of cards in the player's hand determines the trump suit and the values are added, modulo ten, to determine the total sum value for the player's hand. Likewise, the suit with the greatest number of cards as between the community cards and the dealer's two cards determines the trump suit and the values are summed, modulo ten, to determine the total sum value for the dealer's hand. The sum values of the player's and dealer's are then resolved according to the above rules.

As can be appreciated, the methods according to the present invention for using and declaring trump suits enhances the excitement of the game. Furthermore, the trump suit is not defined until cards are dealt to the player and dealer. Thus, the anticipation, when the player is viewing their cards, of a preferred trump suit being defined increases the excitement of the game.

While I have shown and described certain embodiments of the present invention, it is to be understood that it is subject to many modifications and changes without departing from the spirit and scope of the appended claims.

I claim:

1. A method for playing a card game between a Dealer and a Player using a deck of playing cards including a plurality of suits, each suit including cards of different values comprising:

the Player making a first wager;

dealing an initial holding of an equal number of cards to the Player and the Dealer and turning the next card from the deck face up, the suit of the turned-up card defining the trump suit;

the Player viewing the initial holding and opting to continue or fold, if the Player opts to continue the Player making a second wager matching the first wager to receive an additional card, if the Player opts to fold, collecting the first wager;

the Player and Dealer receiving a first additional card, the Player opting to continue or fold, if the Player opts to continue the Player making a third wager matching the first wager to receive a second additional card, if the Player opts to fold, collecting the first and second wagers;

the Player and Dealer receiving the second additional cards to complete their hands;

resolving the completed Dealer's hand versus the Player's hand by (a) comparing the sums of the values of the trump suit cards of the Player's hand to that of the Dealer's, (i) if the Player's sum is greater, declaring the Player's hand a winner and paying the Player based upon each of the first, second and third wagers, (ii) if the Dealer's sum is greater, the Player's hand declared a loser and all of the Player's wagers are collected (iii) if the sum is the same, declaring the Dealer or Player's hand with the highest ranking trump card the winner and (b) if neither the Player or the Dealer have any trump cards, declaring the Player or Dealer hand with the highest ranking card the winner.

2. The method of claim 1 wherein the Player and Dealer are dealt initial hands of three cards.

3. The method of claim 1 wherein the Player and Dealer are dealt initial hands of four cards.

4. The method of claim 1 wherein the Player and Dealer are dealt initial hands of five cards.

5. The method of claim 2 of valuing the trump cards for summing as 10's through Kings each valued as 10 and Ace valued as 11 and the remainder of the cards counting their face value.

6. The method of claim 2 further including the Player opting to make a side wager and if the Player makes the side wager paying the Player based upon the bonus wager according to the following Table 1:

TABLE 1

| No. of Trump Cards | Sum of Trump Cards | Payoff |
|---|---|---|
| 2 | 17–21 | 1 to 1 |
| 3 | 22–26 | 2 to 1 |
| 3 | 27–31 | 3 to 1 |
| 4 | 17–21 | 4 to 1 |
| 4 | 22–26 | 5 to 1 |
| 4 | 27–31 | 7 to 1 |
| 4 | 32–36 | 10 to 1 |
| 4 | 37–40 | 15 to 1 |
| 5 | Any | 20 to 1 |
| 5 | Poker Straight | 50 to 1 |

7. The method of claim 6 further including allocating a portion of each bonus wager to a progressive jackpot and awarding the progressive jackpot if the Player's hand is a Royal Flush in trump cards.

8. The method of claim 1 further including the Player making a side wager that the trump suit will be red or black and paying the player even money on winning side wagers and collecting losing side wagers.

9. The method of claim 1 including valuing the 10's through Kings as zero and the Aces as one.

10. A method for playing a card game between a Dealer and a Player using a deck of playing cards including a plurality of suits, each suit including cards of different values comprising:

the Player making a wager;

dealing an initial holding of seven cards to the Player and the Dealer and turning the next card from the deck face up, the suit of the turned-up card defining the trump suit;

the Player and Dealer organizing their seven cards into a trump hand containing only trump suit cards and a second suit hand all of cards of another suit;

resolving the completed Dealer's trump hand and second suit hand versus the Player's corresponding hands by the sum of the values of cards in each hand (i) if the Player's sums for each of the hands are greater, declaring the Player's hands winners and paying the Player based upon the wager, (ii) if the Dealer's sums for both hands are greater, declaring the Player's hands losers and all collecting the Player's wager and (iii) if only one of the Player's hands has a greater sum, declaring the hands a push.

11. The method of claim 10 including the Player making a second wager, said wager and second wager allocated respectively to each of the trump and second suit hands.

12. A method for playing a card game between a Dealer and a Player using a deck of playing cards including a plurality of suits, each suit including cards of different values comprising:

the Player selecting a card suit and making a wager with respect to that suit;

dealing five cards to the Dealer and the Player and turning the next card from the deck face up, the suit of the turned-up card defining the trump suit;

comparing the number of cards of the selected suit and trump cards of the Dealer's hand with the number of cards of the selected suit and trump suit of the Player's hand, the Dealer or Player with the most trump and selected suit cards declared the winner; and if the Player is declared the winner paying the player even money and if the Dealer is declared the winner, the Player losing their wager.

13. The method of claim 12 including paying the Player one and a half time their wager if the Player is declared the winner and the trump suit and selected suit are the same.

14. A method for playing a card game between a Dealer and a Player using a deck of playing cards including a plurality of suits, each suit including cards of different values comprising:

the Player making a wager;

dealing a first card face up to each of the Dealer and the Player, said first card defining the first card of each of a Dealer and a Player hand;

exposing the next card as the trump card, the suit of the trump card designating the trump suit;

the Player completing their hand by, (i) standing on the first card, (ii) opting to receive additional cards to have a hand sum value of six or less, cards 2–9 each having their face value and remaining cards each having a value of 1, or (iii) at any time the Player opting to split pairs of cards appearing in the Player's hand into two Player hands by placing an additional wager and exercising with respect to each hand the options (i) or (ii) above, after the Player has completed their hand, the Dealer completing their hand by, (i) standing on the first card value of less than three, or (ii) opting to receive additional cards to have a hand sum value of six or less, cards 2–9 each having their face value and remaining cards each having a value of 1, resolving the completed hands by the following rules, (i) if any completed Player hand has a sum value exceeding 6, declaring the Player hand a loss and the Dealer collecting the Player's wager, (ii) if the Player hand has a sum value of 6 or less and dealer's hand sum value is greater than 6, declaring the Player hand a winner and paying the Player even money on their wager;

(iii) if the sum value of the Player and Dealer hand are the same, determining the number of trump suit cards in each of the completed hands, the Player or the Dealer with the most trump suit cards declared the winner and if neither the Player or the Dealer have any trump suit cards or the same number of cards, declaring the hands a push.

15. A method for playing a card game between a Dealer and a Player using a deck of playing cards including a plurality of suits, each suit including cards of different values comprising:

the player making a wager;

dealing two cards to the Dealer and Player, at least one of the Dealer's card turned face up;

the Player assessing their two cards and opting to double their wager and receive two additional cards or to stand on their original two cards, said two card or opted for four card hand defining the Players final hand;

dealing two additional cards to the Dealer;

comparing the Dealer's and Player's hands to determine the outcome according to the following rules, (i) the Player must have at least two suited cards to have a qualifying hand, if neither the Player or Dealer have at least two suited cards the hand is declared a push, (ii) the suited cards of the Player having a sum, modulo ten, closest to 9 deemed the trump suit for the Player, said sum representing the total sum value of the Player's hand, (iii) the suited cards of the Dealer having a sum, modulo ten, closest to 9 deemed to be the Dealer's trump suit, said sum representing the total sum value of the Dealer's hand, (iv) if the total sum value for the Player's hand exceeds the total sum value for the Dealer's hand, the Player is declared the winner and is paid even money on the wager(s), if the total sum value for the Dealer's hand exceeds the total sum value of the Player's hand, the Dealer is declared the winner and the wager(s) are collected, and (v) if the total sum values are the same but not zero, the hand is declared a push, if the total sum values are the same and zero, the Dealer is declared the winner and the wager(s) are collected.

16. The method of claim 15 further including resolving the Player and Dealer hands according to the rules of, (vi) if the player has two qualifying trump suits of at least two cards of the same sum, modulo ten, the player is declared the winner and is paid 2:1 on the wager(s) unless the Dealer also has two qualifying trump suits of at least two cards of the same and greater sum, modulo ten in which case the Dealer is declared the winner and the wager(s) are collected, and (vii) if both the Player and Dealer have two qualifying trump suits of the same sum, modulo ten, the Player is declared the winner and is paid even money on the wager(s).

17. The method of claim 15 further including resolving the Player and dealer hands according to the rule of, (viii) if the Player and Dealer both have the same total sum value, the Player or Dealer with the most trump suit cards declared the winner, if the Player and dealer both have the same number of trump cards the hands declared a push.

18. The method of claim 15 further including the Player opting to make either of a red or black wager prior to the dealing of the cards and paid even money on their wager in the event the Player's trump suit color matches the wagered upon color.

19. The method of claim 15 including dealing two cards to each the Player and Dealer and dealing three community cards at the center of the table to be used by the Player and Dealer to determine the trump suit and total sum value for the Player and Dealer hands, the Player having no opportunity to double their wager.

* * * * *